United States Patent [19]

Rockwell

[11] Patent Number: 4,964,632

[45] Date of Patent: Oct. 23, 1990

[54] COMPACT MULTI-FUNCTION WEIGHT-TRAINING EXERCISER

[75] Inventor: Gary L. Rockwell, Auburn, Ala.

[73] Assignee: Diversified Products Corporation, Opelika, Ala.

[21] Appl. No.: 403,404

[22] Filed: Sep. 6, 1989

[51] Int. Cl.[5] ..... A63B 21/062

[52] U.S. Cl. ..... 272/118

[58] Field of Search ..... 272/72, 117, 118, 134, 272/144, DIG. 4

[56] References Cited

U.S. PATENT DOCUMENTS

| | | | |
|---|---|---|---|
| Re. 31,170 | 3/1983 | Mazman | 272/118 |
| 931,699 | 8/1909 | Medart | 272/118 |
| 3,734,495 | 5/1973 | Nist et al. | 272/118 |
| 3,917,262 | 11/1975 | Salkeld | 272/118 |
| 4,149,714 | 4/1979 | Lambert, Jr. | 272/118 |
| 4,169,589 | 10/1979 | McArthur | 272/118 |
| 4,226,414 | 10/1980 | Coffaro et al. | 272/117 |
| 4,336,934 | 6/1982 | Hanagan et al. | 272/72 |
| 4,505,475 | 3/1985 | Olschansky et al. | 272/118 |
| 4,828,254 | 5/1989 | Maag | 272/134 |
| 4,890,830 | 1/1990 | Kern | 272/117 |

FOREIGN PATENT DOCUMENTS

| | | | |
|---|---|---|---|
| 2158362A | 11/1985 | United Kingdom | 272/134 |

OTHER PUBLICATIONS

Advertisement for the "Pulldown Latissimus Machine" In Recreation, Sports and Leisure, p. 14, 9/1982.

DP Chairman Fitness System, 1987 Catalog of Diversified Products Corporation, pp. 12–13.

*Primary Examiner*—Robert W. Bahr

*Attorney, Agent, or Firm*—Banner, Birch, McKie & Beckett

[57] ABSTRACT

A compact multi-function weight-training exerciser having at least one pivoted handlebar lever efficiently matches liftable weight-training resistance to the exercising forces applied by the user. The handlebar levers can be simply and easily reconfigured in a variety of rest positions to facilitate a variety of exercises. Cable and linkages are efficiently laid out and housed within the frame of the apparatus.

11 Claims, 4 Drawing Sheets

COMPACT MULTI-FUNCTION WEIGHT-TRAINING EXERCISER

BACKGROUND OF THE INVENTION

The invention relates to physical exercising apparatus and, more particularly, to exercising apparatus which affords a variety of weight-training exercises.

Many configurations of weight-training equipment are known in the exercise equipment art. In many of these, at least one pivoted handlebar level having a handgrip at its free end is rotated by a user from a rest position against a resistive force afforded by a vertically guided weight assembly, a pneumatic cylinder, or other means that resists movement of the handlebar lever. Typically an actuating mechanism, such as a pulley and cable arrangement, camming mechanisms, chain couplings or the like interconnect the handlebar lever and the resistance means to, for example, lift the weight assembly or actuate a piston within the pneumatic cylinder.

Most weight-training equipment of the aforementioned type is large and bulky, and is not well suited for domestic use, where space often is at a premium. Size and bulk are an acute problem with so-called "multi-station" equipment, which provides a plurality of stations surrounding one frame, each station usually designed for performing only a single type of exercise. More compact units tend to lack versatility, typically being of the "single station" type devoted to only one type of exercise.

It has proven desirable, especially for domestic use, to configure weight-training equipment in such a way as to increase its versatility for performing many different types of exercises. This typically is done by reconfiguring various portions of the equipment so that exercise forces may be applied in many different directions to many parts of the user's body. However, conversion of such equipment from one mode of operation to another typically is a rather complicated, cumbersome and time-consuming operation. And these multi-functional machines still tend to be rather sizable.

SUMMARY OF THE INVENTION

It is, therefore, an object of the invention to provide a multi-function weight-training exerciser that is relatively compact in size and easy to convert from one mode of operation to another.

Another object of the invention is to provide such an exerciser having at least one pivoted handlebar lever wherein the rest position of the handlebar lever is easily and readily changed to facilitate different types of exercises with minimal changeover effort.

Another object of the invention is to provide such an exerciser, wherein a guided weight assembly provides the resistive force, having a pulley and cable actuating system that is substantially fully contained within the frame of the exerciser.

These and other objects of the invention are accomplished by providing a physical exercising apparatus having a frame, a vertically guided liftable weight assembly on the frame, a seat and a backrest on the frame, at least one moveable handlebar lever pivoted at its upper end relative to the frame about a transverse axis located above the backrest and having a handgrip at its lower end that can be grasped and pushed forwardly by a user seated on the seat with his back against the backrest to perform a seated chest press exercise, and actuating means including a cable and pulley arrangement operatively interconnecting the handlebar lever and the weight assembly, whereby pivotal movement of the handlebar lever during exercise raises and lowers the weight assembly. The actuating means comprises a lower lever behind the backrest pivoted at one end to the frame, an upwardly extending lift member behind the backrest pivoted at its lower end to the medial portion of the lower lever, motion converting means for converting forward pivotal movement of the handlebar lever to upward movement of the lift member, and vice versa, a primary upper pulley on the frame above the weight assembly, a primary lower pulley on the frame, and cable means interconnecting the weight assembly and the distal end of the lower lever, and trained around the primary upper and primary lower pulleys, for raising and lowering the weight assembly, whereby pivotal movement of the handlebar lever raises the lift member and the lower lever and pulls the cable means, thereby lifting the weight assembly.

In another aspect of the invention, the physical exercising apparatus includes a frame, a seat and a backrest on the frame, at least one moveable handlebar lever pivoted at its upper end relative to the frame about a transverse pivot axis located above the backrest and above the head of a user seated on the seat with his back against the backrest, the handlebar lever having a handgrip at its lower end that can be grasped and pushed forwardly by the user, to perform a seated chest press exercise, from a rest position adjacent the user's chest to an extended position with the user's arms extended, thereby rotating the handlebar lever about the pivot axis, a crank arm rotatable about the pivot axis in unison with the handlebar lever, and resistance means on the frame operatively connected to the crank arm for resisting rotation of the handlebar lever from its rest position. Footrests are provided on the lower front portion of the frame below and in front of the seat on which the user can stand when performing alternate exercises in a standing position in front of the apparatus. Further, selector means is provided for adjustably locking the angular position of the handlebar lever relative to the crank arm whereby the handlebar lever can be selectively placed in various rest positions to facilitate various exercises. The handlebar lever in one of the rest positions extends forwardly with the handgrip located in front of the seat and approximately at shoulder height of a user standing on the footrests to facilitate a standing or "military" press exercise. The apparatus preferably has two handlebar levers symmetrically arranged with respect to the backrest, each of the handlebar levers having a handgrip at its lower end.

BRIEF DESCRIPTION OF THE DRAWINGS

The invention is diagrammatically illustrated, by way of example, in the accompanying drawings in which.

DETAILED DESCRIPTION

Figure 1:
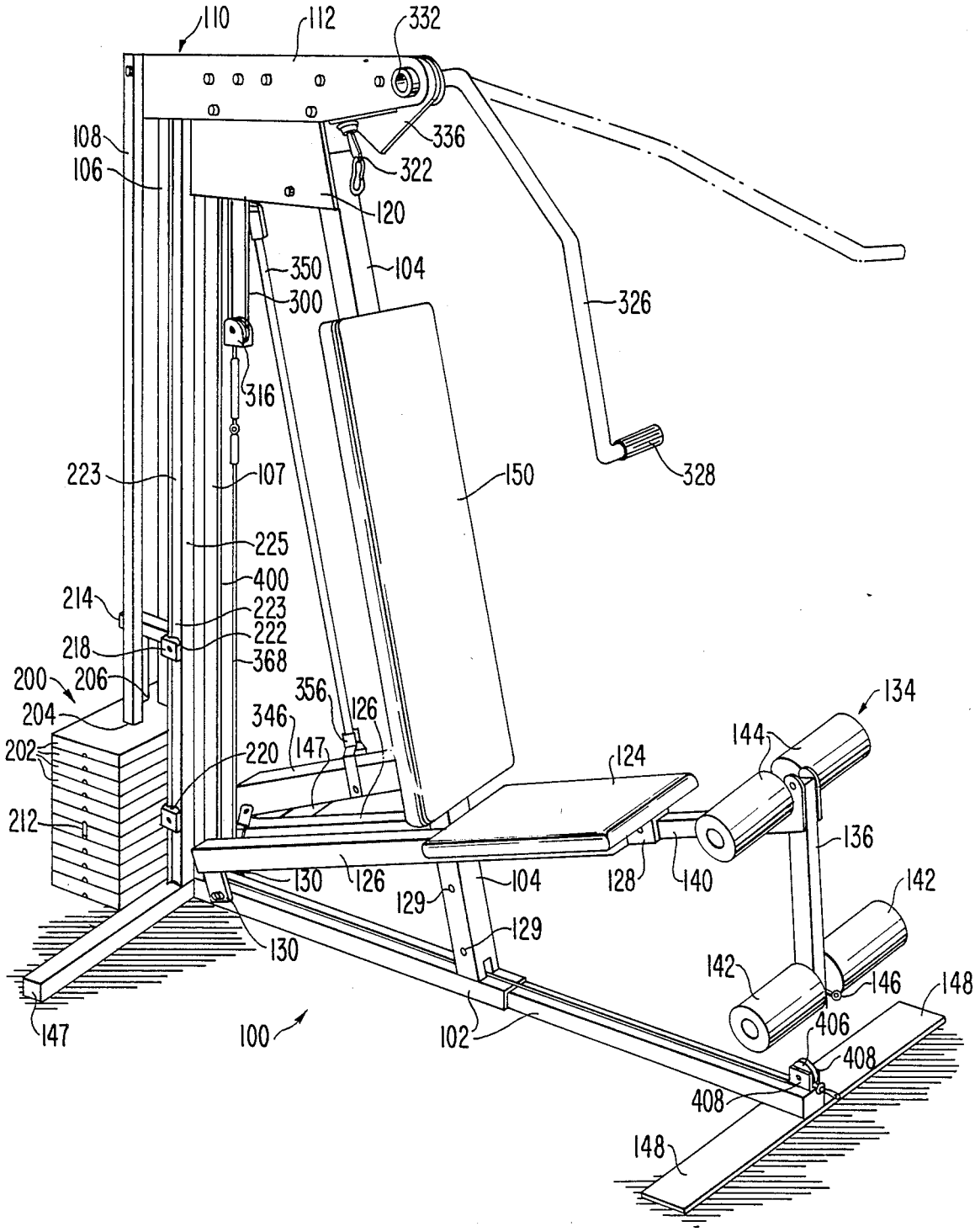
FIG. 1 is a perspective view of the apparatus according to the invention with one of the handlebar levers removed for the sake of simplicity.
Figure 2:
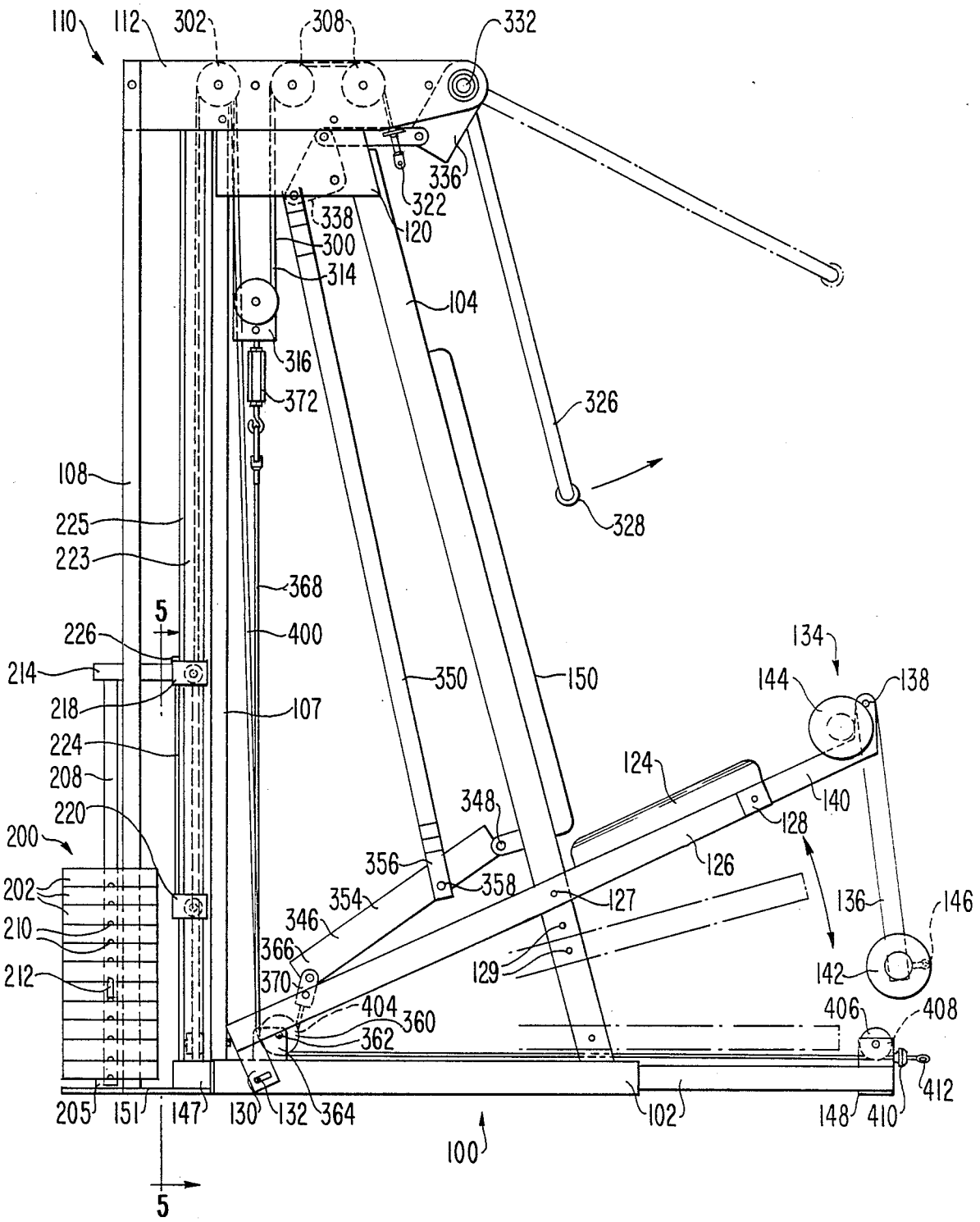
FIG. 2 is a side elevational view of the apparatus of FIG. 1.
Figure 3:
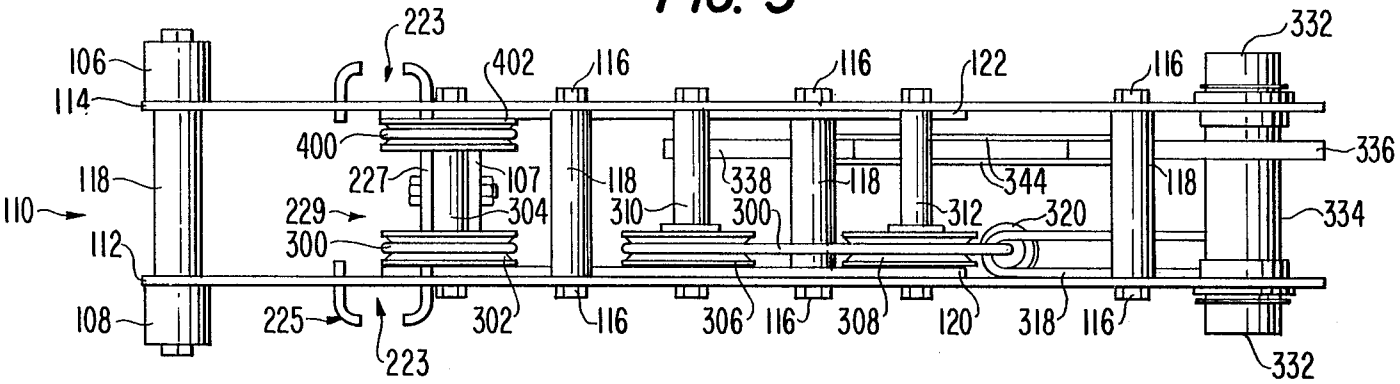
FIG. 3 is a top plan view of the apparatus of FIGS. 1 and 2, showing details of the upper end of the apparatus.

Referring to FIGS. 1, 2 and 3, exercising apparatus according to the invention comprises a frame 100 formed of tubular steel having a central base member 102, an oblique front frame member 104, spaced vertical rear frame members 106, 108, a central vertical rear frame member 107, and a top frame member 110 consisting of spaced plates 112, 114 that are bolted together by bolts 116 and separated by spacers 118 (see FIG. 3). Additional side plates 120, 122 are bolted to plates 112, 114, respectively, extend therebelow, and are welded to vertical member 107 and front frame member 104. A cushioned seat 124 is bolted to a seat subframe comprising parallel members 126 that are joined together at their front ends by a socket assembly 128. The rear ends of members 126 carry slotted pivot plates 130 that are pivoted to base member 102 at 132. The height of seat 124 can be adjusted by selectively pinning members 126 to front frame member 104 through holes 127 in members 126 and selected holes 129 in member 104. Socket 128 is adapted to receive and support a leg exercising accessory 134 comprising an arm 136 pivoted at 138 to mounting member 140, with padded lateral cushions 142 attached to arm 136 and padded cushions 144 attached to mounting member 140. An eyebolt 146 is attached to the distal end of arm 136 and is adapted to be connected to a cable, as described below, which provides resistance to upward pivotal movement of arm 136. Laterally extending footrests 148 are attached to the front end of base member 102, and help to laterally stabilize the apparatus. Lateral stability also is enhanced by laterally extending rear base members 147, which are attached to central base member 102. A weight platform 151 (FIGS. 2 and 5) is attached at floor level to base member 147. A backrest 150 is bolted to oblique front frame member 104.

Resistance means in the form of a liftable weight assembly 200 provides selective resistance to exercising movements of a user of the apparatus. Weight assembly 200 comprises a stack of rectangular weights 202 each having a pair of square apertures 204 that receive vertical rear frame members 106, 108, which serve to guide vertical movement of weights 202. When at rest weights 202 are supported on a stop member 205 (FIG. 2) that is carried by weight platform 151. Each weight 202 has a third central aperture 206 which receives a weight rod 208. Weight rod 208 has a series of holes (not shown) that register with arcuate lateral recesses 210 (FIG. 2) on the underside of weights 202. A weight selector rod 212 is insertable into a selected recess 210 through the aligned hole in weight rod 208, beneath a selected number of weights 202. Weight rod 208 is attached at its upper end to a lift beam 214, which is cantilevered to the rear of a carriage 216. Referring to FIGS. 2-5, carriage 216 comprises upper and lower C-shaped brackets 218, 220 that are interconnected by an elongated plate 224. Wheels 222 are journalled at the ends of brackets 218, 220 and ride within the outwardly facing tracks 223 of an extruded aluminum rail 225. Rail 225 has a front web 227 that is bolted to frame member 107, and a rear channel 229. A forwardly projecting flange 226 (FIG. 5) welded to the top of upper bracket 218 projects into rear channel 229 of rail 225. Flange 226 has spaced holes 228, 230, each adapted to receive a lifting cable, as described below.

Figure 5:
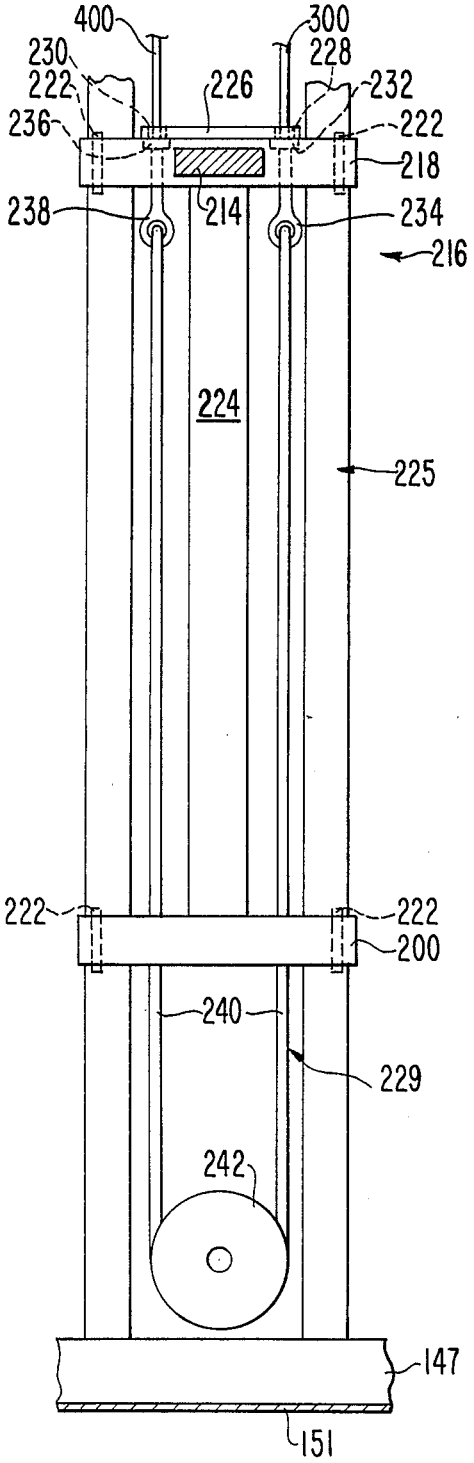
FIG. 5 is a sectional view of the apparatus taken along line 5—5 in FIG. 2.

Referring to FIG. 5, weight assembly 200 can be raised and lowered by one of two lifting cables 300, 400. Primary lifting cable 300 is received in hole 228 in flange 226 and has at its end an enlarged cable stop 232 connected to an eyebolt 234. Similarly, secondary lifting cable 400 is received in hole 230 and has at its end an enlarged cable stop 236 connected to an eyebolt 238. Eyebolts 234, 238 are interconnected by an elastic cord 240 that is trained around a bottom pulley 242. In operation, when either cable 300, 400 lifts flange 226 and, with it, carriage 216 and a selected number of weights, flange 226 rides along the unused cable, with elastic cord 240 keeping the unused cable taught to prevent fouling with flange 226. This dual-cable, elastic-cord concept is disclosed in U.S. Pat. No. 4,697,809, which is incorporated herein by reference.

Figure 4:
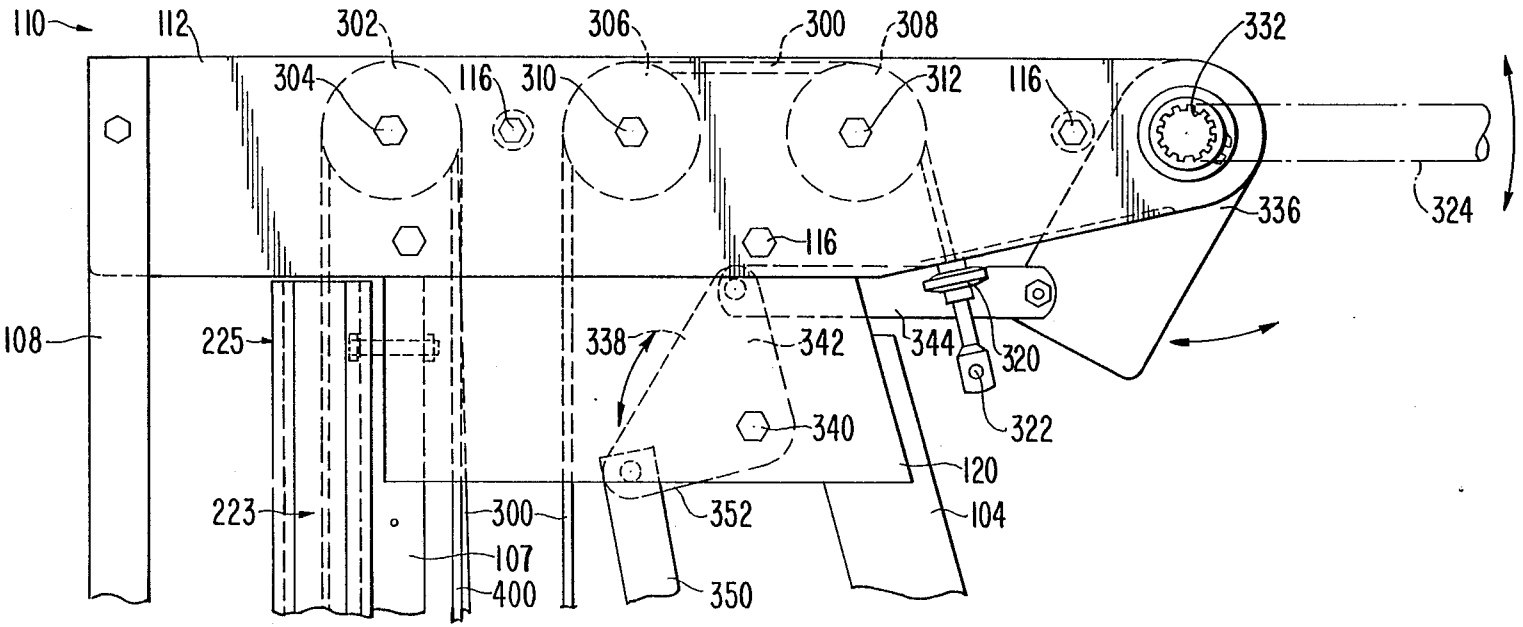
FIG. 4 is a partial side elevational view of the apparatus of FIGS. 1–3, showing details of the upper end of the apparatus.

Referring to FIGS. 2, 3 and 4, primary lifting cable 300 extends upwardly from carriage 216 and is trained over a primary upper pulley 302, which is journalled on an axle 304 between plates 112 and 114. Auxiliary upper pulleys 306, 308 similarly are journalled on axles 310, 312, respectively, between plates 112 and 114. Primary lifting cable 300 extends downwardly from primary upper pulley 302 and then upwardly over auxiliary upper pulleys 306, 308, thereby forming a loop or bight portion 314 which engages a traveling pulley 316. Cable 300 emerges from between plates 112, 114 through a slotted cable guide 318 secured to plate 112. Primary lifting cable 300 terminates in an enlarged cable stop 320 and an eye 322 to which other cables or handle type exercise devices can be attached. Cable stop 320 prevents retraction of primary lifting cable 300, thus anchoring the cable at that end so that downward movement of traveling pulley 316 during exercise will translate into upward movement of the opposite end of primary lifting cable 300 to lift the carriage and weight assembly.

Figure 6:
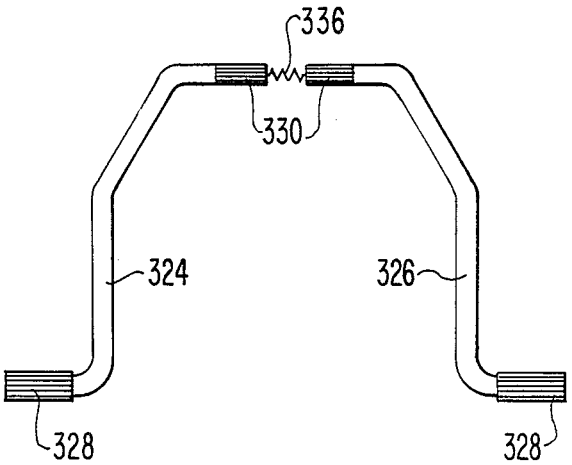
FIG. 6 is a detail view of the handlebar levers used with the apparatus of the invention.

Downward movement of traveling pulley 316 to raise weight assembly 200 is effected by an actuating mechanism that transmits rotating movement of handlebar levers 324, 326 (FIG. 6) to the traveling pulley. Handlebar levers 324, 326 have handgrips 328 at their lower ends, and splined tips 330 at their upper ends that fit into splined axial sockets 332 in the ends of a pivot shaft 334, which is journalled about a transverse axis in plates 112, 114. A spring-biasing mechanism 336, schematically illustrated in FIG. 6, urges the splined tips 330 of handlebar levers 324, 326 into engagement with axial sockets 332, but permits the splined tips to be withdrawn sufficiently to reposition the handlebar levers to different rest positions, as described more fully below.

A crank arm 336 is welded to pivot shaft 334 and rotates therewith. A bell crank 338 is pivoted at 340 to plates 120, 122. The upper leg 342 of bell crank 338 is connected to crank arm 336 by a double-sided link 334. A lower lever 346 is pivoted at 348 to the rear of front frame member 104. A lift member 350 is connected at its upper end to the lower leg 352 of bell crank 338, and at its lower end to the medial portion 354 of lower lever 346 by means of a clevis 356 and a bolt 358. A primary lower pulley 360 is journalled on an axle 362 carried by a pair of brackets 364 (only one of which is shown in FIG. 2) which are attached to base member 102. The distal end 366 of lower lever 346 is connected to traveling pulley 316 by means of an intermediate cable 368, a clevis 370 and a turnbuckle 372, intermediate cable 368 passing beneath primary lower pulley 360.

Referring to FIG. 3, axle 304 also supports a secondary upper pulley 402. Similarly, axle 362 (FIG. 2) supports a secondary lower pulley 404 which lies behind but is hidden by primary lower pulley 360, as viewed in FIG. 2. A front pulley 406 is journalled between brackets 408 at the front end of base member 102. Secondary lifting cable 400 extends upwardly from carriage 216, over secondary upper pulley 402, downwardly and under secondary lower pulley 404 and forwardly, emerging between brackets 408 beneath pulley 406. An enlarged cable stop 410 at the front end of cable 400 engages brackets 408, within an eye 412 adapted to be connected to various exercising accessories, as described below.

FIGS. 1 and 2 illustrate handlebar lever 326 in one rest position, in preparation for a user to perform a seated chest press exercise with his back against backrest 150. The other handlebar lever 324 would occupy a corresponding rest position at roughly chest height on the opposite of backrest 150, so that handgrips 328 comfortably can be gripped by the user and pushed forwardly to rotate the handlebar levers and, with them, pivot shaft 334 and crank arm 336. Rotation of crank arm 336 pulls link 334 forwardly to rotate bell crank 338 clockwise as seen in FIGS. 2 and 4. This movement raises lift member 350, which causes lower lever 346 to pivot upwardly about its fulcrum 348, pulling intermediate cable 368. As cable 368 is pulled, traveling pulley 316 moves downwardly. With the outer end of primary lifting cable 300 anchored by cable stop 320, the cable stop 232 on the inner end of cable 300 exerts a lifting force on flanges 226 and causes carriage 216 along with the selected number of weights to rise. The weight assembly, no longer supported at rest on the frame, thus provides resistance to the user's arm movements exerted on the handgrips 328. The resistance force is not linear, however, owing to the changes in effective lever arms that occur as crank arm 336, bell crank 338 and lower lever 346 change their angular positions relative to link 334 and lift member 350. Specifically, the resistive force desirably increases as the user's arms are extended, which tends to maximize the efficiency of the exercise being performed. Further, the size of the weight stack and the available resistance afforded thereby is efficiently matched to the effort applied by the user through the relatively long handlebar levers 324, 326, which themselves afford the user a rather high mechanical advantage. To counteract this advantage, the connection between lift member 350 and lower lever 346 is in the medial portion of the lower lever. In addition, the use of a traveling pulley 316 further reduces the mechanical advantage. This arrangement therefore precludes the need for an unduly large number of weights to afford the proper resistance when using the handlebar levers.

The splined connection 330, 332 between handlebar levers 324, 326 and pivot shaft 334 allows the user to select any one of a number of possible rest positions for the handlebar levers. This is done simply by pulling each handlebar lever out of its associated socket 332 against the spring force, rotating the handlebar lever to the desired new rest position and reengaging the splines. Thus, for example, the handlebar levers can be arranged in a rest position corresponding to that illustrated in phantom in FIGS. 1 and 2 for performing a standing or "military" press. With this arrangement, the user stands facing the machine with his feet on footrests 148 and his hands grasping the handgrips 328 in their rests positions at roughly should height. More or less vertical movement of the handgrips 328 causes rotation of the pivot shaft and results in elevation of the weight assembly 200. Another possible rest position for handlebar levers 324, 326 is disposed with handgrips 328 somewhat to the rear of backrest 150, just within arm's reach of a user seated on seat 124 and facing backrest 150. Such a rest position would be suitable for performing a so-called chest pull or seated row type of exercise. Other rest positions for the handlebar levers are possible.

Primary lifting cable 300 can be used for performing altenate exercises independent of handlebar levers 324, 326. This is accomplished by attaching various forms of exercising accessories to the eye 322 at the end of cable 300. For example, a lat pulldown bar attached to eye 322 can be used to perform lat pulldown exercises with the user seated on seat 124 facing backrest 150. Other types of exercises using the primary lifting cable 300 may also be performed. For each of these, traveling pulley 316 remains immobile, and weight assembly 200 is lifted directly by the force applied to cable 300.

The secondary lifting cable 400 similarly may be used to perform additional exercises using accessories attached to eye 412. For example, eye 412 and eye 146 of the leg exercising assembly 134 may be interconnected to permit leg lifts to be performed with the user seated on seat 124 with his knees over padded cushions 144 and his ankles beneath padded cushions 142. Leg curls may be performed with the user standing on one leg at a time with the front part of his lower thigh against the front of padded cushion 144 and the rear of the ankle exerting a lifting force against padded cushion 142. Leg exercising assembly 134 may be removed and a curl bar attached to eye 412 so that wrist curls or arm curls can be performed with the user seated on seat 124. Many other types of exercises can be performed utilizing secondary lifting cable 400.

It is readily apparent that the pulleys, cables and various linkages are efficiently laid out and substantially completely housed within the confines of the frame. Side covers (not shown) can be attached by bolts or the like to the frame to cover the open space bounded by rear frame member 107, base member 102, front frame member 104 and top frame member 110, thereby concealing the working parts from the probing fingers of small children and presenting a clean look that is all but lacking in many cable-operated weight-training devices of the prior art.

It is to be understood that the above described apparatus is but one example of the invention. It will be apparent to one of ordinary skill that modifications and changes may be made in the structure of the invention without departing from the true spirit and scope of the invention, which is defined by the appended claims. For example, any suitable equivalent mechanism could be used for transmitting rotating movement and torque of pivot shaft 334 to lower lever 346, e.g., a crank arm in the form of a cam with a peripheral chain or cable passing over a gear or pulley and downwardly to lower lever 346. The term "crank arm" as used in the claims thus is to be construed broadly as a torque transmitting element that rotates with, or could be a part of, the handlebar levers. Instead of using the splined connections 330, 332, the handlebar levers themselves could be joined together at the top and the entire handlebar assembly releasably indexed with respect to the pivot shaft. Other modifications will be apparent to those skilled in the art.

I claim:

1. In a physical exercising apparatus having a frame; a vertically guided liftable weight assembly on said frame; a seat and a backrest on said frame; at least one moveable handlebar lever pivoted at its upper end relative to said frame about a transverse axis located above said backrest and having a handgrip at its lower end that can be grasped and pushed forwardly by a user seated on the seat with his back against the backrest to perform a seated chest press exercise; and actuating means including a cable and pulley arrangement operatively interconnecting said handlebar lever and said weight assembly whereby pivotal movement of said handlebar lever during exercise raises and lowers said weight assembly, the improvement wherein said actuating means comprises:

a lower lever behind said backrest pivoted at one end to said frame;

an upwardly extending lift member behind said backrest pivoted at its lower end to the medial portion of said lower lever;

motion converting means for converting forward pivotal movement of said handlebar lever to upward movement of said lift member, and vice versa;

a primary upper pulley on said frame above said weight assembly;

a primary lower pulley on said frame; and cable means interconnecting said weight assembly and the distal end of said lower lever, and trained around said primary upper and primary lower pulleys, for raising and lowering said weight assembly, whereby pivotal movement of said handlebar lever raises said lift member and said lower lever and pulls said cable means, thereby lifting said weight assembly.

2. Physical exercising apparatus according to claim 1 wherein said cable means comprises:

a primary lifting cable attached at one end to said weight assembly, trained over said primary upper pulley and anchored at its other end to said frame, said primary lifting cable hanging with a bight portion between said primary upper pulley and its anchored end;

a traveling pulley engaging the bight portion of said primary lifting cable; and an intermediate cable trained under said primary lower pulley and interconnecting said traveling pulley and the distal end of said lower lever.

3. Physical exercising apparatus according to claim 2 wherein the anchored end of said primary lifting cable is located above said backrest, further comprising:

at least one auxiliary upper pulley on said frame in front of said primary upper pulley, said primary lifting cable between its bight portion and its anchored end trained over said auxiliary upper pulley;

stop means at the anchored end of said primary lifting cable limiting retraction but permitting extension of the anchored end thereof; and primary coupling means on the anchored end of said primary lifting cable for attaching auxiliary exercise equipment, whereby additional exercises can be performed by pulling on the anchored end of said primary lifting cable to directly lift said weight assembly.

4. Physical exercising apparatus according to claim 3 further comprising:

a secondary upper pulley on said frame above said weight assembly;

a secondary lower pulley on said frame;

a secondary lifting cable attached at one end to said weight assembly, trained over said secondary upper pulley and around said secondary lower pulley and emerging at the lower front of the apparatus; and secondary coupling means at the distal end of said secondary lifting cable for attaching auxiliary exercise equipment, whereby additional exercises can be performed by pulling on the distal end of said secondary lifting cable to directly lift said weight assembly.

5. Physical exercising apparatus according to claim 4 wherein said primary upper pulley and said secondary upper pulley are mounted on a common axle, and said primary lower pulley and said secondary lower pulley are mounted on a common axle.

6. Physical exercising apparatus according to claim 5 wherein said motion converting means comprises:

a crank arm pivotable in unison with said handlebar lever;

a bell crank pivoted to said frame behind said crank arm, said lift member pivoted to the lower leg of said bell crank; and a link interconnecting said crank arm and the upper leg of said bell crank, whereby pivotal movement of said handlebar lever rotates said crank arm, pulls said link, rotates said bell crank and raises said lift member.

7. Physical exercising apparatus according to claim 2 wherein said motion converting means comprises:

a crank arm pivotable in unison with said handlebar lever;

a bell crank pivoted to said frame behind said crank arm, said lift member pivoted to the lower leg of said bell crank; and a link interconnecting said crank arm and the upper leg of said bell crank, whereby pivotal movement of said handlebar lever rotates said crank arm, pulls said link, rotates said bell crank and raises said lift member.

8. Physical exercising apparatus according to claim 7 wherein said frame comprises:

a base member;

a vertical rear frame member attached to said base member adjacent which said weight assembly moves;

an oblique front frame member attached to said base member and supporting said backrest; and a top frame member interconnecting said front and rear frame members and supporting said upper pulleys; said bell crank, said lift member, said lower lever, all of said pulleys and substantially all but the exposed end portions of said cables all lying within the confines of said frame members.

9. Physical exercising apparatus according to claim 1 wherein said motion converting means comprises:

a crank arm pivotable in unison with said handlebar lever;

a bell crank pivoted to said frame behind said crank arm, said lift member pivoted to the lower leg of said bell crank; and a link interconnecting said crank arm and the upper leg of said bell crank, whereby pivotal movement of said handlebar lever rotates said crank arm, pulls said link, rotates said bell crank and raises said lift member.

10. Physical exercising apparatus according to claim 9 wherein said frame comprises:

a base member;

a vertical rear frame member attached to said base member adjacent which said weight assembly moves;

an oblique front frame member attached to said base member and supporting said backrest; and a top frame member interconnecting said front and rear frame members and supporting said upper pulleys; said bell crank, said lift member, said lower lever, all of said pulleys and substantially all but the exposed end portions of said cables all lying within the confines of said frame members.

11. Physical exercising apparatus according to claim 1 wherein said frame comprises:

a base member;

a vertical rear frame member attached to said base member adjacent which said weight assembly moves;

an oblique front frame member attached to said base member and supporting said backrest; and a top frame member interconnecting said front and rear frame members and supporting said primary upper pulley; said lower lever, said lift member, said primary upper pulley, said primary lower pulley and said cable means all lying substantially within the confines of said frame members.

* * * * *